US006974343B2

(12) United States Patent
Zheng et al.

(10) Patent No.: US 6,974,343 B2
(45) Date of Patent: Dec. 13, 2005

(54) SIM CARD CONNECTOR

(75) Inventors: Qisheng Zheng, Kunsan (CN); Shaoping Du, Kunsan (CN); Bo Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/957,180

(22) Filed: Sep. 30, 2004

(65) Prior Publication Data

US 2005/0070171 A1 Mar. 31, 2005

(30) Foreign Application Priority Data

Sep. 30, 2003 (TW) ..... 92217527 U

(51) Int. Cl.[7] ..... H01R 13/62
(52) U.S. Cl. ..... 439/326
(58) Field of Search ..... 439/630, 326, 439/331

(56) References Cited

U.S. PATENT DOCUMENTS 5,226,826 A 7/1993 Nillson et al.
5,337,220 A * 8/1994 Granitz ..... 361/816
5,603,629 A * 2/1997 DeFrasne et al. ..... 439/331
5,775,949 A * 7/1998 Bricaud et al. ..... 439/630
5,813,878 A * 9/1998 Kuwata et al. ..... 439/326
5,933,328 A * 8/1999 Wallace et al. ..... 361/737
5,961,338 A * 10/1999 Wu et al. ..... 439/326
5,984,707 A * 11/1999 Kuwata ..... 439/326
5,996,891 A 12/1999 Braun
6,024,593 A * 2/2000 Hyland ..... 439/326
6,062,889 A * 5/2000 Hyland et al. ..... 439/326
6,095,868 A 8/2000 Hyland et al.
6,099,337 A * 8/2000 Chan ..... 439/326
6,106,317 A * 8/2000 Michaelis et al. ..... 439/326
6,149,466 A * 11/2000 Bricaud et al. ..... 439/630
6,174,188 B1 * 1/2001 Martucci ..... 439/326
6,176,721 B1 * 1/2001 Gottardo et al. ..... 439/260
6,210,193 B1 * 4/2001 Ito et al. ..... 439/326
6,220,882 B1 * 4/2001 Simmel et al. ..... 439/326
6,234,810 B1 * 5/2001 Schnell et al. ..... 439/76.1
6,241,545 B1 * 6/2001 Bricaud et al. ..... 439/326
6,319,036 B1 * 11/2001 Zheng et al. ..... 439/326
6,368,138 B1 * 4/2002 Huang ..... 439/331
6,447,338 B1 * 9/2002 Bricaud et al. ..... 439/630
6,468,101 B2 * 10/2002 Suzuki ..... 439/326
6,471,550 B2 * 10/2002 Maiterth et al. ..... 439/631
6,641,441 B2 * 11/2003 Liu ..... 439/630
6,719,579 B2 * 4/2004 Tisserand et al. ..... 439/331
6,743,035 B1 * 6/2004 Yang ..... 439/326
6,761,575 B2 * 7/2004 Bricaud et al. ..... 439/326
6,805,570 B1 * 10/2004 Lee ..... 439/326
6,863,537 B2 * 3/2005 Pellizari ..... 439/31
6,869,302 B2 * 3/2005 Bricaud et al. ..... 439/326

(Continued)

*Primary Examiner*—Ross Gushi
(74) *Attorney, Agent, or Firm*—Wei Te Chung

(57) ABSTRACT

An electrical card connector (100) includes a base (1), a cover (2) and a pivot (3) for pivotally connecting the cover with the base. The base includes an insulative housing (11) and a number of conductive terminals received in the housing. The cover includes a top cover (21) and a bottom cover (22) defining a receptacle (20) for receiving a card (4). The cover defines a cutout (25) on the bottom cover facing to an upper surface of the base and has latching mechanism (26) extending from opposite sides of the cutout for latching with the base and for hold the cover in a locked position.

11 Claims, 8 Drawing Sheets

U.S. PATENT DOCUMENTS 6,881,086 B2 * 4/2005 Ohashi ..... 439/326
6,890,203 B2 * 5/2005 Matsunaga et al. ..... 439/331
6,896,548 B2 * 5/2005 Scuteri et al. ..... 439/541.5
2005/0064748 A1 * 3/2005 Zheng et al. ..... 439/150
2005/0070171 A1 * 3/2005 Zheng et al. ..... 439/700
2005/0095893 A1 * 5/2005 Zheng et al. ..... 439/326

* cited by examiner

SIM CARD CONNECTOR

BACKGROUND OF THE INVENTION

1. Field of the Invention

The present invention generally relates to an electrical card connector, and more particularly, to a card connector used in a portable electronic device for connecting an electrical card to a printed circuit board of the portable electronic device.

2. Description of the Related Art

As electronics technology advances, electronic cards are being more widely used with electronic devices such as mobile phones, personal computers, notebooks, and personal digital assistants (PDAs). Electronic card connectors for electronic memory cards, such as smart cards and subscriber identification modular (SIMs), are well known in communications industries. U.S. Pat. No. 6,095,868 discloses a card connector including a base and a removable and separate cover dimensioned to receive a card. The base has a plurality of flanges extending outwardly at opposite side walls thereof and each defining a downwardly step clamping surface. The cover comprises a plurality of dampers at opposite sides thereof and each projecting a boss defining an upwardly facing surface. The cover having the card therein is off-set downwardly with respect to the base during a closed position of assembly with the flanges are positioned beside respective clampers. As the cover is translated to a locked position, the cover with an inserted card are rearwardly moved relatively to the base and the facing surfaces of the dampers interferentially fit with the clamping surfaces of the base and become latched with the base. A protrusion extends upwardly from front portion of the base and has a card stop surface preventing a front movement of the inserted card. A cantilevered beam extends downwardly from a top cover for providing frictional force on the inserted card and for strengthening the connection between the inserted card and the card connector when the card is fully inserted into the card connector.

With the ever-increasing miniaturization of the electrical card and corresponding connector, various problems continue to arise. For instance, when the card is inserted into and removed from the card-receiving cavity or receptacle or other means of the connector, the proper position of the card in the connector and the proper engagement with the terminals present problems. In addition, in assembly, the dampers of the cover and the flanges of the base bias the cover and the base together, the cover requires amount vertical space above upper surface of the base to assemble to the base. Moreover the protrusion positions at front portion of the base resulting a sizeable base corresponding to the cover. It is often increases the overall dimensions of the assemblies.

SUMMARY OF THE INVENTION

The present invention is directed to an electrical card connector that alleviates some of the problems associated with the prior art. Accordingly, the primary object of the present invention is to provide a new and improved electrical card connector having a compact structure for securely and precisely connecting with an inserted card.

An electrical card connector in accordance with the present invention comprises a base, a cover and hinging means for pivotally connecting the cover with the base. The base includes an insulative housing and a plurality of resilient conductive terminals received in the housing. The cover includes a top cover, a bottom cover and opposite lateral plates. The cover defines a cutout on the bottom cover facing to an upper surface of the base and has resilient latching means on opposite sides of the cutout for latching with the base to hold the cover in a locked position. The opposite lateral plates include cooperating locking sections operable upon full assembly defining a receptacle for receiving a card. A rib is downwardly formed on the top cover and adjacent to the receptacle. The contact terminals project upwardly into the receptacle through the cutout to secure reading of an inserted card and cooperate with the rib for preventing a front movement of the inserted card.

Other objects, advantages and novel features of the invention will become more apparent from the following detailed description when taken in conjunction with the accompanying drawings.

DETAILED DESCRIPTION OF THE PREFERRED EMBODIMENT

Figure 1:
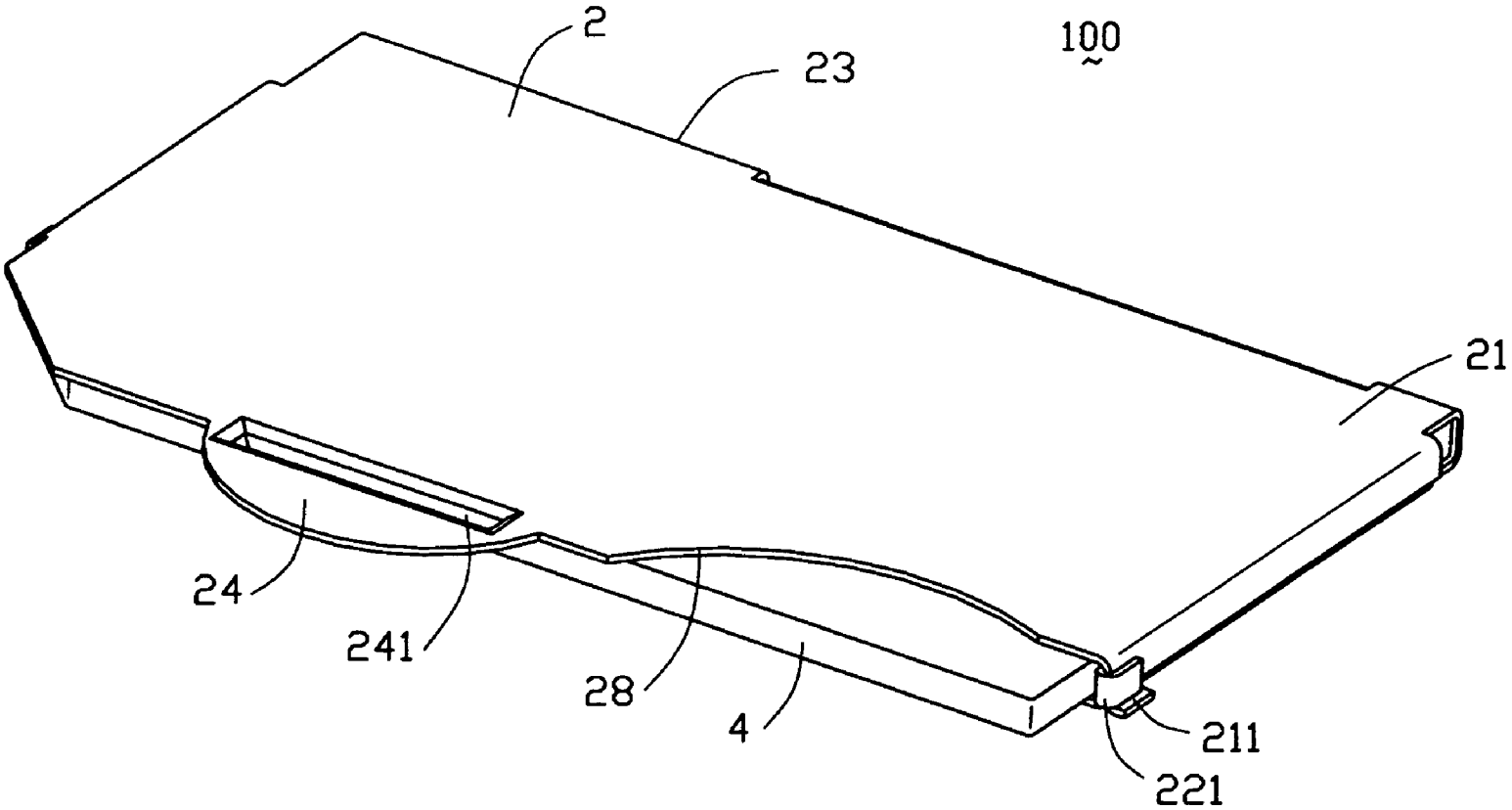
FIG. 1 is a perspective view of an electrical card connector according to the present invention, but with a card received therein.
Figure 2:
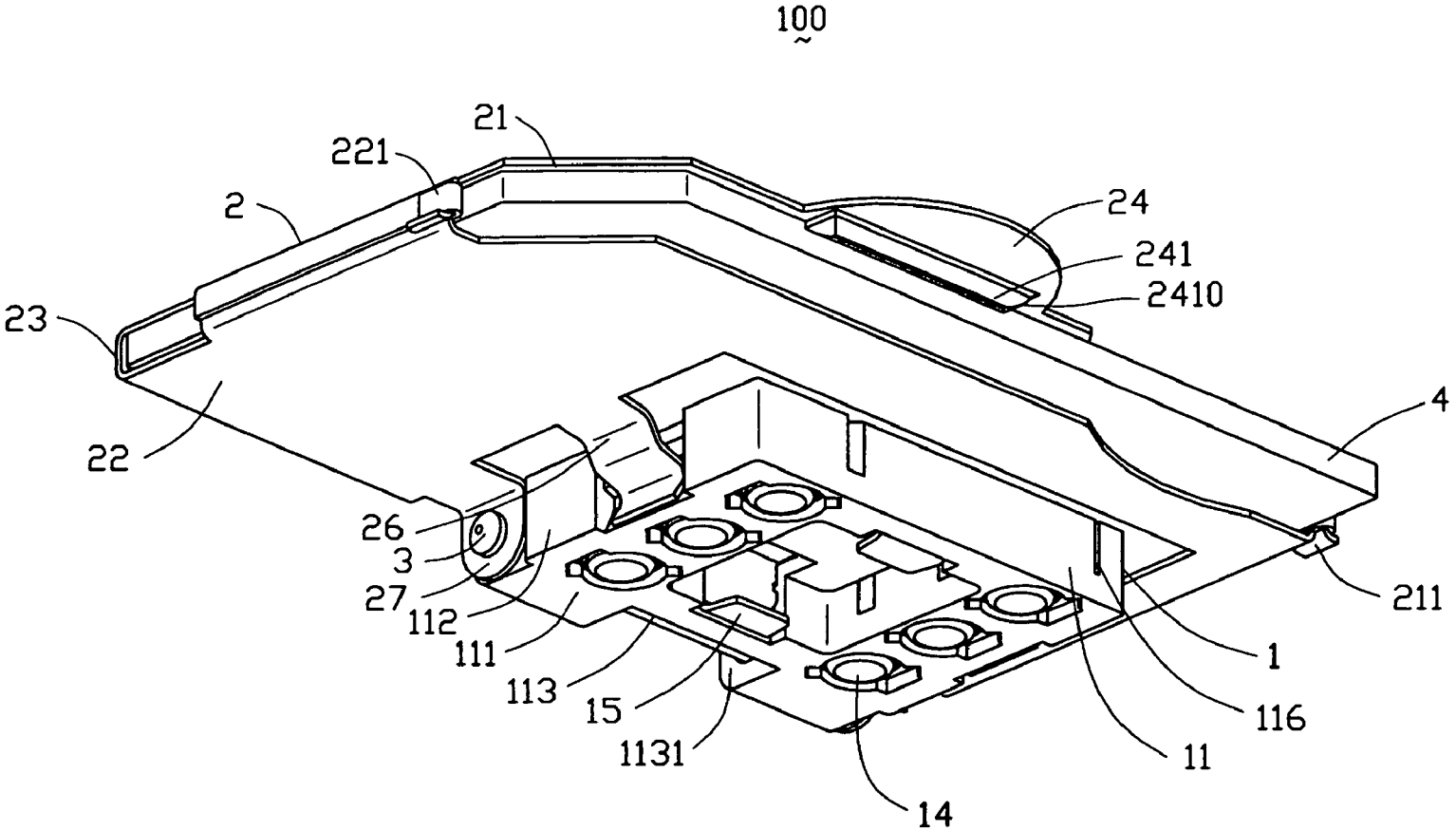
FIG. 2 is another perspective view of the electrical card connector of FIG. 1.

Reference will now be made in detail to the preferred embodiment of the present invention.

Referring to FIGS. 1–4, an electrical connector 100 in accordance with the present invention comprises a base 1, a cover 2 and a pivot 3 for pivotally connecting the cover 2 with the base 1.

Referring to FIGS. 5–8, the base 1 includes a substantially rectangular insulative housing 11, a plurality of conductive terminals received in the housing 11 and a pair of engaging sheets 15. The housing 11 includes an upper surface 110, a lower surface 111, opposite side walls 112 and a rear wall 113. The housing 11 defines a plurality of through holes 114 through the upper and lower surfaces 110, 111 adjacent to the opposite side walls and defines a pair of engaging slots 115 at middle thereof. The housing 11 includes a top step 1141 inwardly and radially projecting into a top portion of each through hole 114. The housing 11 defines a recess communicating with a bottom portion of each through hole 114. The recess has the same axis as each through hole 114 and has a diameter larger than that of each through hole 114, thereby forming a bottom step 1143 in the bottom portion of the each through hole 114. The housing 11 has a plurality of pairs of parallel fixing slots 116 through the upper and lower surfaces 110, 111 and each pair of fixing slots 116 are position at opposite sides of each through hole 114. Each side wall 112 forms an outwardly projecting protrusion 1120 and defines a concaved snapping slot 1121 beneath the protrusion 1120. A pair of hook portions 1131 extend rearwardly and upwardly from opposite side portions of the rear wall 113 and each hook portion 1131 defines an upwardly exposed cylindrical groove 1130.

The conductive terminals are received in the through holes 114 of the housing 11 and each comprises a contact terminal 12, a spring 13 and a fixing terminal 14. Each contact terminal 12 includes a sleeve body section 121 and a convex contact section 124 covering at a top end of the body section 121 for contacting with circuit traces of an inserted card 4. The body section 121 and the convex contact section 124 define a downwardly exposed recess 123. A mounting flange 122 extends perpendicularly and outwardly from a lower periphery of the body section 121 and cooperates with the top step 1141 of the housing 11.

The fixing terminal 14 includes a base portion 141 and a pair of symmetrical fixing arms 142 extending upwardly from the base portion 141. The base portion 141 has a substantially cap-shaped configuration and defines an upwardly exposed hollow space 143 for abutting against a lower end of the spring 13. The base portion 141 has a bottom solder nod (not labeled) for soldering to a printed circuit board (PCB, not shown). Each fixing arm 142 has an outwardly projecting tuber 144 formed thereon for cooperating with the fixing slots 116 of the housing 11.

The spring 13 is received in the through hole 114 of the housing 11. The lower end of the spring 13 abuts against the hollow space 143 and the upper end of the spring 13 extends into the recess 123 abutting against an inner surface of the convex contact section 124.

Each engaging sheet 15 includes a vertical engaging portion 151 latching in the engaging slot 115 of the housing 11 and a solder portion 152 perpendicularly and inwardly extending from a lower end of the engaging portion 151 for soldering to the PCB.

Figure 3:
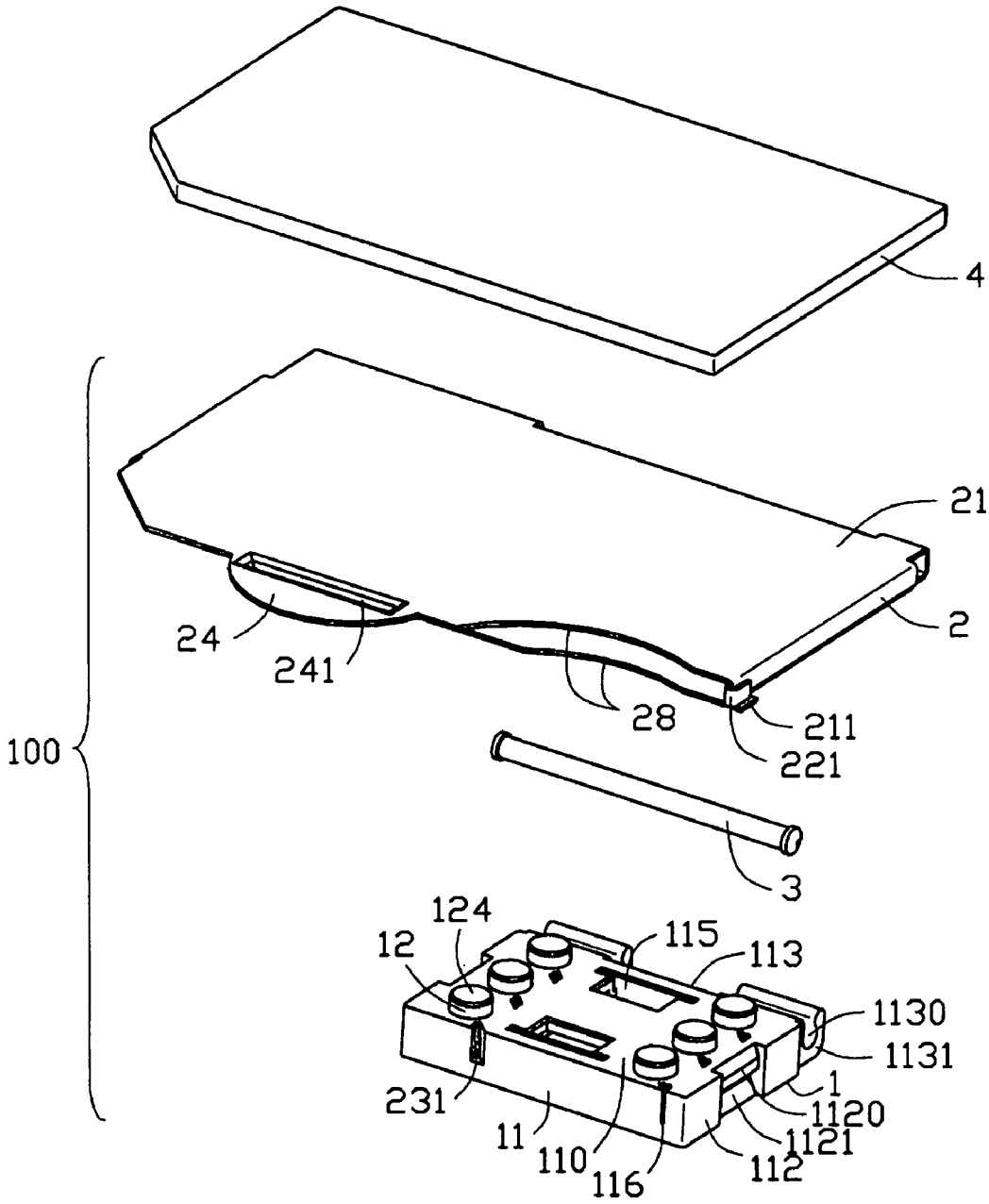
FIG. 3 is an exploded view of FIG. 1.
Figure 4:
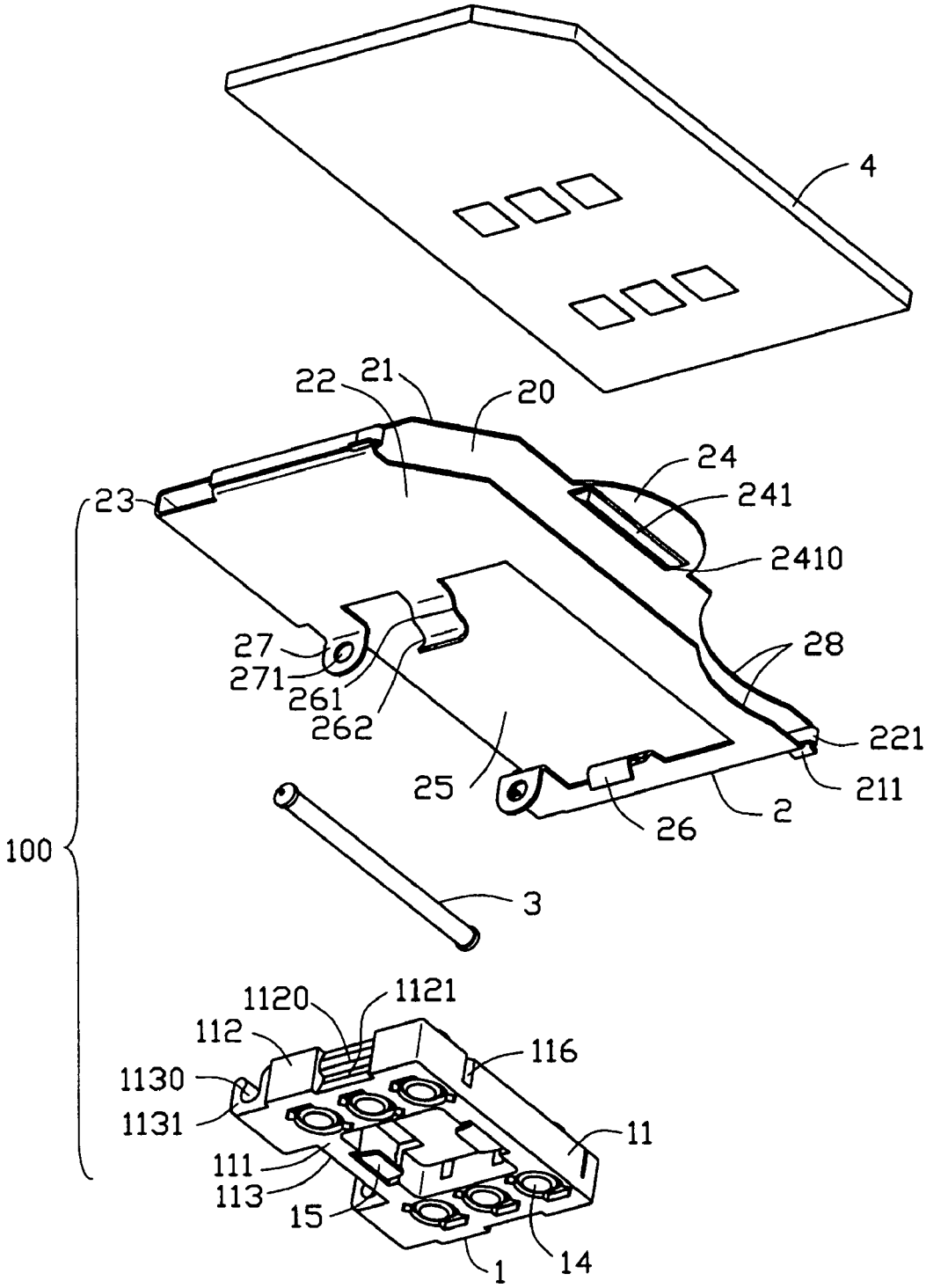
FIG. 4 is an exploded view of FIG. 2.
Figure 5:
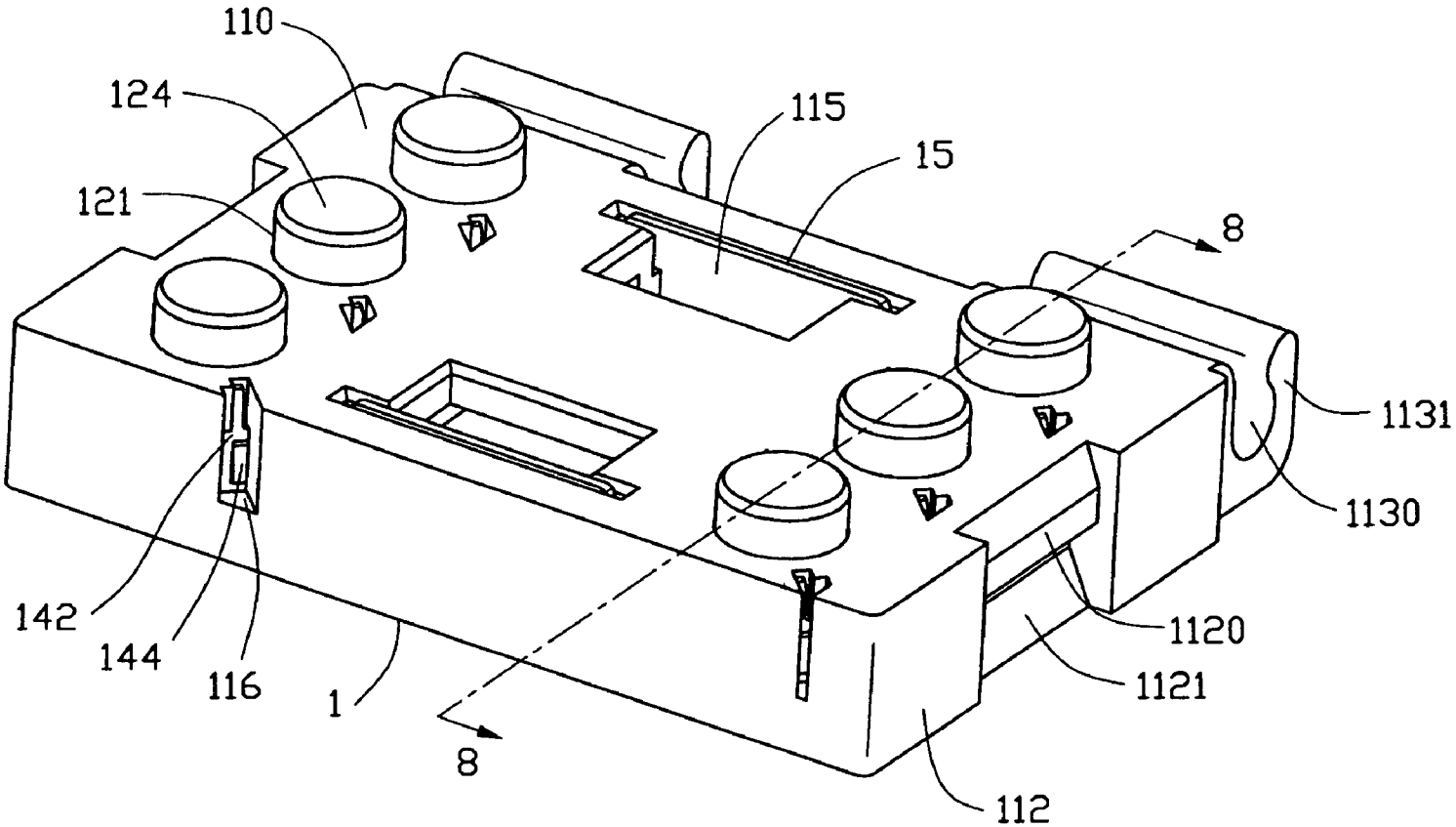
FIG. 5 is a perspective view of a base of the electrical card connector according to the present invention.
Figure 6:
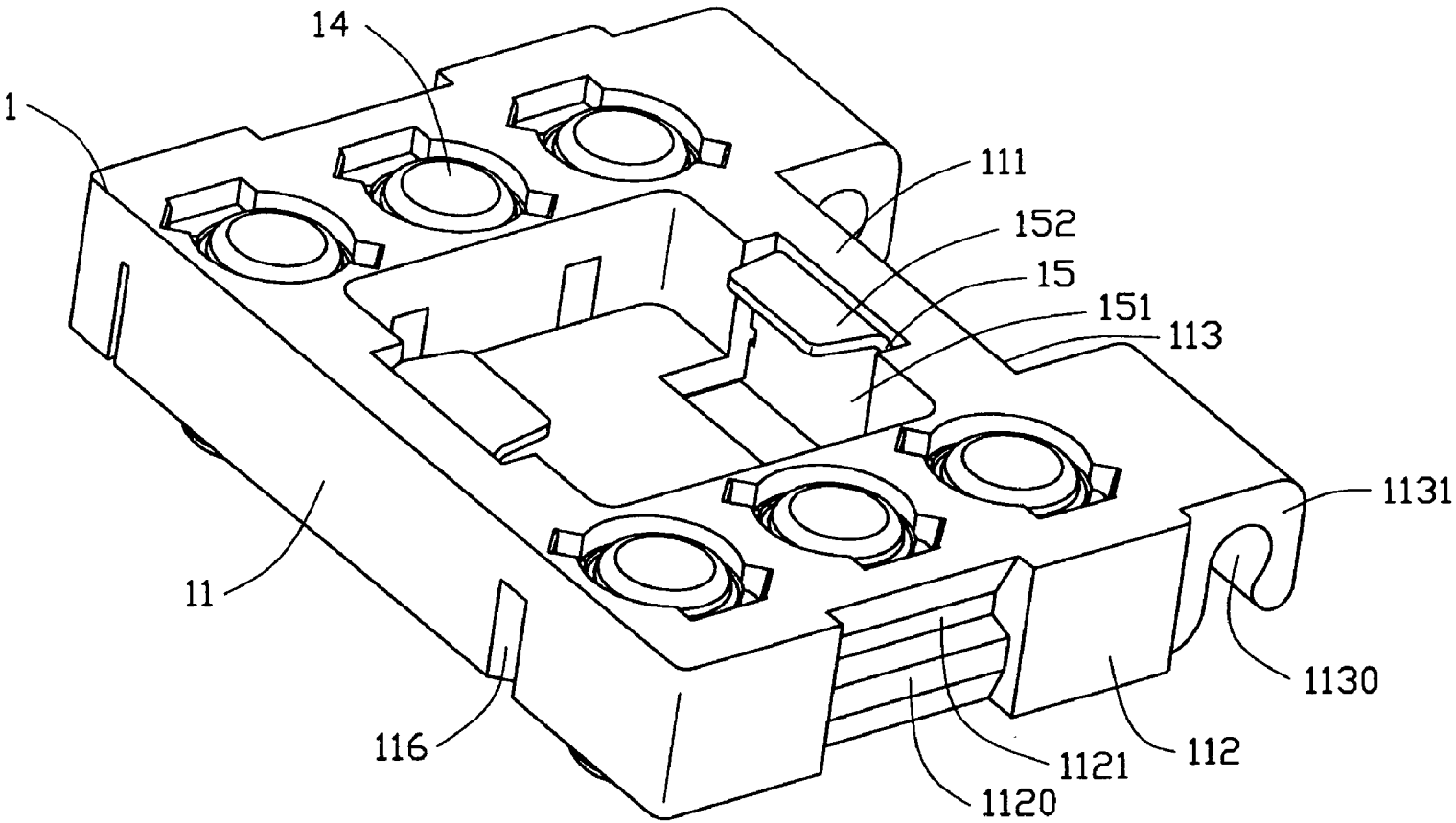
FIG. 6 is an upside-down view of FIG. 5.
Figure 7:
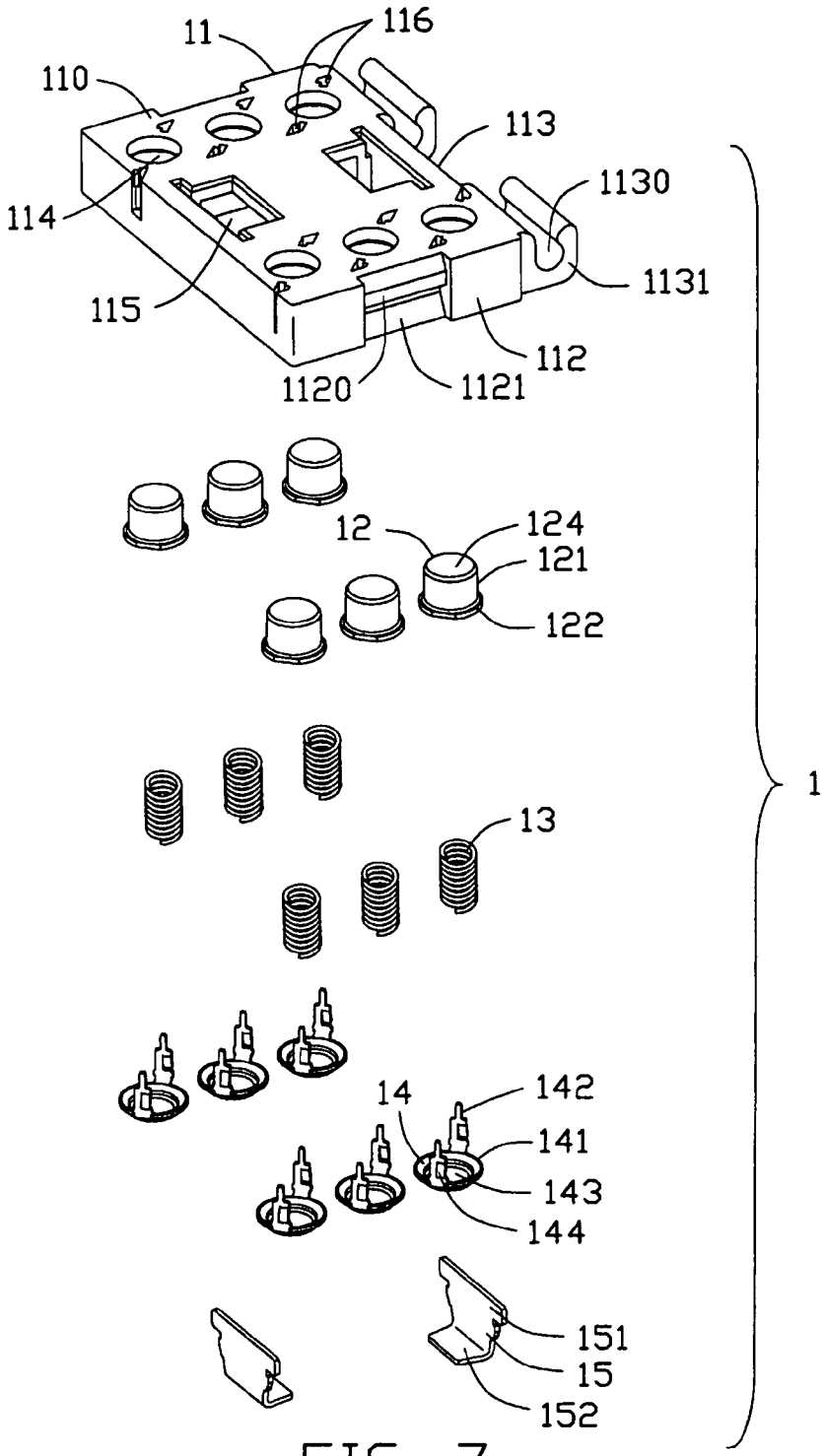
FIG. 7 is an explode view of FIG. 5.
Figure 8:
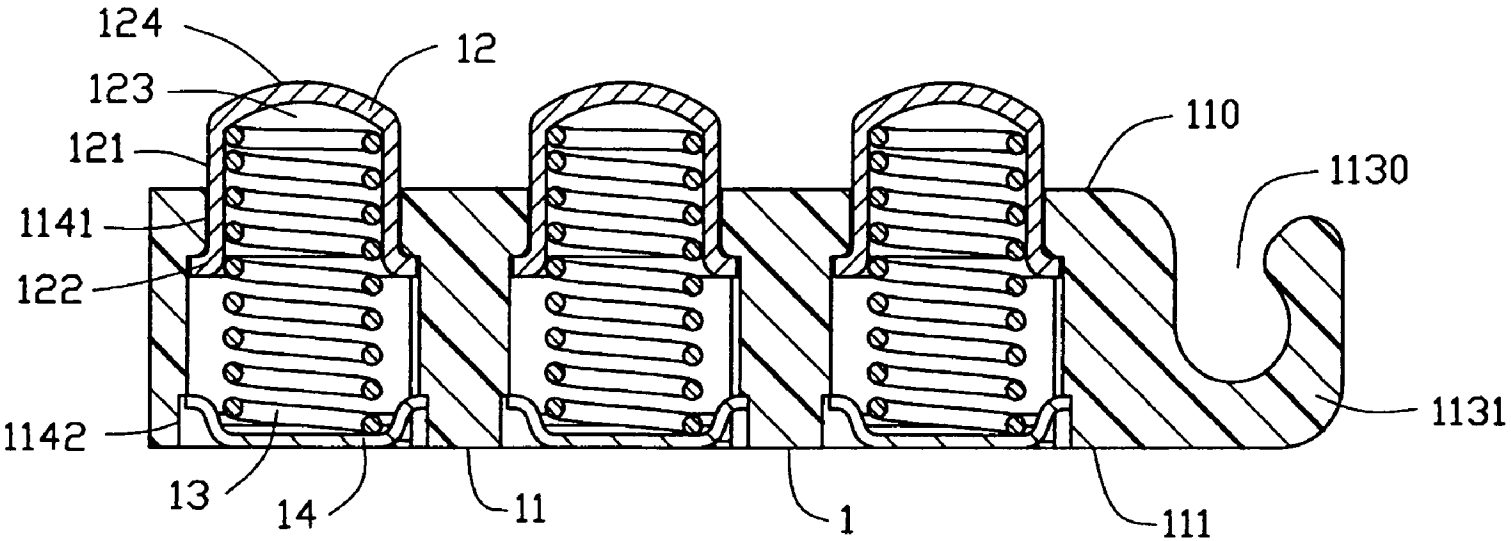
FIG. 8 is a cross-sectional view taken along line 8—8 of FIG. 5.

Referring to FIGS. 3 and 4, the cover 2 includes a top cover 21, a bottom cover 22 and a rear cover 23 extending between rear edges of the top cover 21 and the bottom cover 22. The top cover 21 comprises a pair of downwardly extending lateral plates. A pair of locking bards 211 extend outwardly and perpendularly from front portions of bottom edges of corresponding lateral plates. The bottom cover 22 comprises a pair of upwardly extending side plates to abut against inner surfaces of the downwardly extending lateral plates of the lock bards 211. A pair of hooks 221 extend from front edges of corresponding side plates of the bottom cover 22 for abutting against outer surfaces of the corresponding lateral plates of the top cover 21. The locking bards 211 cooperate with the hooks 221 so as to mount the top cover 21 and the bottom cover 22 together, thereby defining a receptacle 20 for receiving the card 4 between the top cover 21 and the bottom cover 22. The height of the receptacle 20 is higher than the thickness of the card 4. A front nose portion 24 extends forwardly from a front edge of the top cover 21. An elongate rib 241 is downwardly formed on the front nose portion 24 and is parallel to the rear cover 23. The rib 241 is position in front of the receptacle 20 and has a leading surface 2410 for leading the card 4 into the receptacle 20. The bottom cover 22 has a cutout 25 through a rear portion thereof and a pair of resilient latching arms 26 extending downwardly and inwardly to each other from the opposite brims of the cutout 25. The latching arm 26 includes a middle concave portion 261 projecting downwardly and an inwardly projecting snapping portion 262 on a distal free end thereof for securely grasping the base 1 therebetween. The cover 2 has a pair of blades 27 extending perpendicularly and downwardly from the bottom cover 2. Each blade 27 is adjacent to a corresponding latching arm 26 and has a pinhole 271 for cooperating with an end of the pivot 3. The cover 2 defines a pair of concave peripheries 28 on top cover 21 and bottom cover 22 for facilitating in extracting the inserted card 4.

The pivot 3 has a substantially cylinder-shaped configuration. The pivot 3 is assembled in the pinholes 271 and engages with the cylindrical grooves 1130 of the hook portions 1131 of the housing 1, whereby the cover 2 is pivotally mounted on the base 1 and can pivotally move toward and away of the base 1.

In assembly, the contact terminals 12 are installed into the through holes 114 of the housing 11 from the lower surface 111 of the housing 11. The body section 121 and the convex contact section 124 of each contact terminal 12 projects beyond the upper surface 110 of the housing 11. The mounting flanges 122 of the contact terminals 12 engage with the top steps 1141 of corresponding through holes 114. The springs 13 are received in the through holes 114 of the housing 11 and the upper end of each spring 13 extends into the recess 123 of the contact terminal 12. The fixing terminals 14 are fixed to the bottom steps 1142 of the though holes 114 from the lower surface 111 of the housing 11. The fixing arms 142 of the fixing terminals 14 are inserted into the fixing slots 116 of the housing 11 with the tubers 144 abutting against the inner surfaces of the fixing slots 116, thereby fixing the fixing terminals 14 to the housing 11. Then in assembly of the cover 2 to the base 1, the pivot 3 engages with the cylindrical grooves 1130 and seats into the pinholes 271 of the blades 27 of the bottom cover 22. The snapping portions 262 of the latching arms 26 snap corresponding snapping slots 1121 and the concave portions 261 engage with the protrusions 1120 of the housing 11, thereby securely retaining the base 1 therebetween.

In using, the top cover 21 is pivotally lifted away the base 1 and the card 4 is inserted into the receptacle 20 of the cover 2. Then, the top cover 21 is downwardly pressed to the base 1 and the latching arms 26 retain the base 1 therebetween. The card 4 exerts a downwardly depressing force on the contact terminals 12. At the same time, the card 4 gets an upward counterforce from the depressed contact terminal 12 and the spring 13 and is upwardly pushed to abut against the top cover 21. The card 4 is retained by the top cover 21 and depresses the contact terminal 12 and the spring 13 so that cannot move in top-and-bottom directions. Meanwhile a front edge of the card 4 is retained by the rib 231 of the top cover 21 and a rear cover 23 so that cannot move in front-and-rear directions, thereby securely retaining the card 4 in the receptacle 20. When the cover 2 pivots away the base 1, the latching arms 26 disengage from the base 1. The card 4 separates with the depressed contact terminals 12 and is free from the upwardly counterforce from the contact terminals 12 and the springs 13. The card 4 falls on inner surface of the bottom cover 22 and is simultaneously relaxed to the rib 231 of the top cover 21. In such a free state, the card 4 can be easily extracted from the receptacle 20 along the inner surface of the bottom cover 22 easily.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector adapted for being mounted on a printed circuit board for an inserted card, comprising:

a base including an insulative housing and a plurality of conductive terminals received in the housing, the terminals can being resiliently moveable upwardly and downwardly in the housing;

a cover including a top cover and a bottom cover and defining a receptacle between the top and bottom covers for receiving the card, the cover defining a cutout on the bottom cover and having latching mechanism on opposite sides of the cutout for latching with the base; and a pivot for pivotally connecting the base with the cover between a closed position where the cover is located adjacent to the base and a locked position where the cover and the base are locked with each other.

2. The electrical card connector according to claim 1, wherein the base has opposite side walls and each forms an outwardly projecting protrusion and defines a snapping slot beneath the protrusion, and wherein the latching mechanism includes a middle concave portion for engaging with the protrusion and a snapping portion on a distal end thereof for biasing against the snapping slot.

3. The electrical card connector according to claim 1, wherein the base has a plurality of through holes at side portions thereof for receiving the terminals.

4. The electrical card connector according to claim 1, wherein the terminal includes a top contact terminal normally upwardly projecting beyond the housing, a bottom fixing terminal for being fixed on the printed circuit board and a spring positioned between the contact terminal and the fixing terminal.

5. The electrical card connector according to claim 4, wherein the top cover forms a rib adjacent to the receptacle, the contact terminals projecting upwardly into the receptacle through the cutout cooperating with the rib for preventing the inserted card from movement.

6. The electrical card connector according to claim 1, wherein the top cover has a pair of downwardly extending lateral plates and the bottom cover has a pair of upwardly extending lateral plates, the lateral plates including cooperating locking sections engaging with each other upon full assembly.

7. The electrical card connector according to claim 1, wherein the cover defines a pair of concave peripheries on top and bottom covers for facilitating in extracting the inserted card.

8. The electrical card connector according to claim 1, wherein the cover has means for mounting the pivot and for pivotally cooperating with the base.

9. An electrical card connector adapted for being mounted on a printed circuit board for an inserted card, comprising:

a base including an insulative housing and a plurality of conductive terminals received in the housing, each of the terminals defining a contacting tip exposed above an upper face of the housing;

a cover including a top cover and a bottom cover and defining a receptacle between the top and bottom covers for receiving the card, the cover defining a cutout on the bottom cover and having latching mechanism adjacent to the cutout for latching with the base; and the cover being pivotally assembled to the housing, said cover defining at least a closed position where the cover is located adjacent to the base and a locked position where the cover and the base are locked with each other by said latching mechanism.

10. The electrical card connector according to claim 9, wherein the top cover is essentially a complete piece for vertically completely shielding the inserted card.

11. The electrical card connector according to claim 9, wherein said latching mechanism is located around a middle portion of the cover while an operation nose portion of the cover is located around a free end area of the cover, opposite to a pivotal area of the cover.

* * * * *